United States Patent [19]

Morbeck

[11] Patent Number: 4,789,245

[45] Date of Patent: Dec. 6, 1988

[54] DISC-TYPE APPARATUS FOR MIXING PAINT CANS

[75] Inventor: James A. Morbeck, Des Plaines, Ill.

[73] Assignee: Miller Paint Equipment, Ltd., Addison, Ill.

[21] Appl. No.: 149,536

[22] Filed: Jan. 28, 1988

[51] Int. Cl.[4] ..... B01F 9/00

[52] U.S. Cl. ..... 366/217; 366/219; 366/605

[58] Field of Search ..... 366/208, 209, 213, 214, 366/217, 219, 220, 605

[56] References Cited

U.S. PATENT DOCUMENTS

| | | | |
|---|---|---|---|
| 835,846 | 11/1906 | Blalock . | |
| 1,448,446 | 3/1923 | Hulbert . | |
| 1,463,626 | 7/1923 | Marrazzo . | |
| 1,755,763 | 4/1930 | Barber . | |
| 2,797,902 | 7/1957 | Beugler | 259/72 |
| 2,894,309 | 7/1959 | Brzowski | 24/263 |
| 3,018,092 | 1/1962 | Johnson | 259/54 |
| 3,229,964 | 1/1966 | Wiseman | 259/57 |
| 3,284,057 | 11/1966 | Duquette | 259/88 |
| 3,421,053 | 1/1969 | Rinard et al. | 317/157.5 |
| 3,542,344 | 11/1970 | Oberhauser | 259/75 |
| 3,609,921 | 10/1971 | Foster et al. | 51/164 |
| 3,706,443 | 12/1972 | Oberhauser | 259/72 |
| 3,735,962 | 5/1973 | Pagano | 259/72 |
| 3,880,408 | 4/1975 | Karjalainen | 259/72 |
| 4,146,335 | 3/1979 | Hutchings et al. | 366/217 |
| 4,281,936 | 8/1981 | Schotter et al. | 366/209 |
| 4,568,194 | 2/1986 | Gargioni | 366/605 |
| 4,588,302 | 5/1986 | Pizzi | 366/209 |

*Primary Examiner*—Robert W. Jenkins

*Attorney, Agent, or Firm*—Milton S. Gerstein; Marvin N. Benn

[57] ABSTRACT

An apparatus for providing gyratory motion to a paint can for mixing the contents of the paint can. The paint can is clamped between an upper and lower clamping plate of a clamping mechanism, which clamping mechanism is fixed to a rotatable disc rotatable in a vertical plane. The lower clamping plate is rotatable independently of the rotation of the mounting disc. The upper and lower clamping plates are moveable toward and away from each other simultaneously via a pair of threaded rods. The lower clamping plate is also provided with a plurality of angularly spaced-apart vertically pivotal, clamping fingers, the upper portions of which extend through slots formed in the circumference of the lower clamping plate, which fingers help to clamp and automatically center the lower rim of a paint can being clamped and mixed. The fingers are urged upwardly before the upward sliding movement of the lower clamping plate via a strike plate slidingly mounted with respect to the drive shaft of the lower clamping plate. A pair of independent and separate drive assemblies are used, one for driving the mounting disc, and one for rotating the lower clamping plate. A pair of ramps are also provided, which pair of ramp plates allow for the continuous in-feed and out-feed of paint cans to be mixed.

19 Claims, 7 Drawing Sheets

DISC-TYPE APPARATUS FOR MIXING PAINT CANS

BACKGROUND OF THE INVENTION

The present invention is directed to an apparatus for mixing paint in a paint can in order that it is thoroughly and completely mixed. There are many prior art apparatuses for mixing paint in cans and containers, such as that disclosed in U.S. Pat. No. 4,281,936-Shotter et al, U.S. Pat. No. 3,880,408-Karjalainen, U.S. Pat. No. 3,284,057-Duquette, and U.S. Pat. No. 2,894,309-Bryzowski. U.S. Pat. No. 4,281,936 discloses a disc-type paint mixing apparatus in which is provided a pair of oppositely- disposed clamping plates for removably and fixedly holding a paint can or container for subsequent rotation about its own central logitudinal axis, as well as revolution via the rotation of the disc to which it is coupled. The rotation of the disc is achieved via a gearing arrangement. U.S. Pat. No. 3,880,408-Karjalainen shows a device for mixing cans of paint in which rotation and revolution is also provided to the paint can or container, which movement of the paint can is provided via a drive mechanism driving a disc which mounts a clamping arm via a pulley and belt arrangement.

U.S. Pat. No. 2,894,309-Bryzowski discloses a liquid mixing apparatus in which a clamping device is provided which utilizes a pair of opposing clamp plates moveable toward and away from each other by an oppositely threaded and rotatable screw.

SUMMARY OF THE INVENTION

It is the primary objective of the present invention to provide an apparatus for mixing paint cans and containers, preferably of the five gallon capacity type, in which the apparatus is embodied by a rotating disc which mounts thereon a clamping mechanism for releasably clamping a paint can to be mixed by the apparatus, so that both rotational and revolving movement to the paint can is provided to thoroughly mix the contents.

It is an objective of the present invention to provide such a disc-type paint mixing apparatus in which the clamping mechanism mounted by the disc of the apparatus includes a pair of oppositely disposed and concurrently moveable upper and lower clamping plates, so that any height of can may be accommodated by the apparatus, while at the same time centrally locating the paint can to be mixed, so as to effectively eliminate vibrations in the apparatus during operation.

It is another objective of the present invention to provide rotational and revolving movement to the paint can via one motor and a pair of independent interconnecting pulley and belt drive mechanisms, the belt drive mechanisms causing the rotation of the disc and the concomitant revolving of the clamping mechanism therewith, and also the rotation of the lower clamping plate to thereby also cause the conjoint rotation of the paint can itself, to thus provide gyratory movement to the paint can to provide thorough mixing of the contents thereof.

It is another objective of the present invention to provide for the rotational movement of the lower clamping plate and the conjoint movement therewith of the paint can being mixed, such that the shaft connected to the lower clamping plate for the driving thereof is provided with relative translational movement with respect to a driving pulley driving the driven shaft associated with the lower clamping plate, so that a push-plate slidingly mounted with respect to one end of the driven shaft in close proximity to the lower clamping plate, is allowed movement toward and away from the lower clamping plate in order to selectively lock and unlock a plurality of radially extending, pivotally attached finger members which clamp the lower portion, or rim, of the paint can during operation when the driven shaft is moved in the upward direction, and which push-plate allows for the release of the finger members upon the opposite movement of the driven shaft.

It is another objective of the present invention to provide a pair of oppositely-disposed ramp plates on opposite vertical side surfaces of the disc mounting the clamping mechanism, which ramp plates are used for in-and-out or through-flow of paint containers for faster production and for the capability of providing automated runs.

The paint can mixing apparatus of the invention includes a mounting disc rotatably mounted in a housing, the central portion of which mounting disc is provided with a rectangularly-shaped window or cut-out in which is positioned the clamping mechanism of the invention. The clamping mechanism of the invention includes an upper clamping plate provided with a plurality of peripherally or circumferentially spaced hook-type members, some of which are used for holding the bale or handle of the paint can while the mixing process is occurring. The clamping mechanism is also provided with a lower, driven clamping plate with which is operatively associated a plurality of pivotally mounted fingers used for helping to clamp the bottom rim of the paint can, as well as to automatically center the paint can during the clamping process. The upper and lower clamping plates are moveable toward and away from eachother via a pair of threaded rods, each threaded rod having two portions being oppositely threaded so that one rotation of the threaded rods will cause opposite movement to the upper and lower clamping plates. The lower clamping plate is fixedly attached to a driven shaft, which driven shaft is driven by a pulley, the driven shaft being, in the preferred embodiment, a hexagonally-shaped piece received in a hexagonally-shaped hollow hub of the pulley, so as to provide sliding movement to the driven shaft relative to the pulley, so that, when the threaded rods are rotated, the lower clamping plate may achieve its upward or downward movements. The clamping mechanism causes the upward and downward movements of the lower clamping plate via a strike or contact plate operatively associated and in contact with a spider arm, the ends of which spider arm are threadedly connected to the pair of threaded rods, so that movement of the spider arm causes conjoint translational movement of the contact plate, so that in the upward movement of the spider arm the lower clamping plate is forced upwardly thereby, with the contact plate also causing the upward pivotal movement of the clamping-centering fingers or jaws, such that the clamping sections thereof project upwardly beyond the upper surface of the lower clamping plate itself, to thereby clamp and automatically center the lower rim of the paint can. Downward movement of the contact plate allows for the contact fingers and lower clamping plate to fall downwardly via gravity or springs.

The paint can clamped by the clamping mechanism of the invention is given rotational movement about its own central longitudinal axis, as well as revolutionary movement via the rotating mounting disc, to thereby provide a gyratory mixing motion to the can. Only one drive motor is utilized, in combination with a pair of independent belt-drive assemblies. The first belt-drive assembly, operatively connected to the drive motor, is used for rotating the mounting disc, to thereby provide the revolutions to the clamping mechanism and the clamped paint can. The second belt-drive assembly, isolated from the first drive assembly, is used for causing the rotation of the paint can itself about its own central longitudinal axis. This second drive-belt assembly includes a plurality of direction-changing pulleys fixedly connected to the mounting disc, so as to be rotated therewith, the belt of this belt-drive assembly being entrained around these direction changing pulleys, and also around the drive pulley rotatingly driving the driven shaft of the lower clamping plate. Rotational movement is given to the drive pulley of the lower clamping plate via a stationary circular track affixed to the housing frame, so that, during the rotation of the mounting disc, and the concomitant movement of the direction-changing pulleys of the second drive-belt assembly therewith, the belt of the second drive-belt assembly is causes the rotation of the drive pulley and the operatively-associated driven shaft of the lower clamping plate, to thereby rotate the lower clamping plate. The drive pulley of the lower clamping plate assembly also includes, in the central hub thereof, a one-way clutch to allow for the manual rotation thereof in order to position the paint can, after the mixing process, at a desired orientation to allow for easy removal of the can from the apparatus.

There are also provided a pair of ramps rotatable with the mounting disc, each ramp defining an upper flat support-surface substantially co-planer with the upper flat surface of the lower clamping plate. These ramps allow for expedited infeed and outfeed of the paint cans being mixed, as well as automated production thereby, via conveyor belts.

BRIEF DESCRIPTION OF THE DRAWINGS

The invention will be more readily understood with reference to the accompanying drawings, wherein.

DETAILED DESCRIPTION OF THE INVENTION

Figure 1:
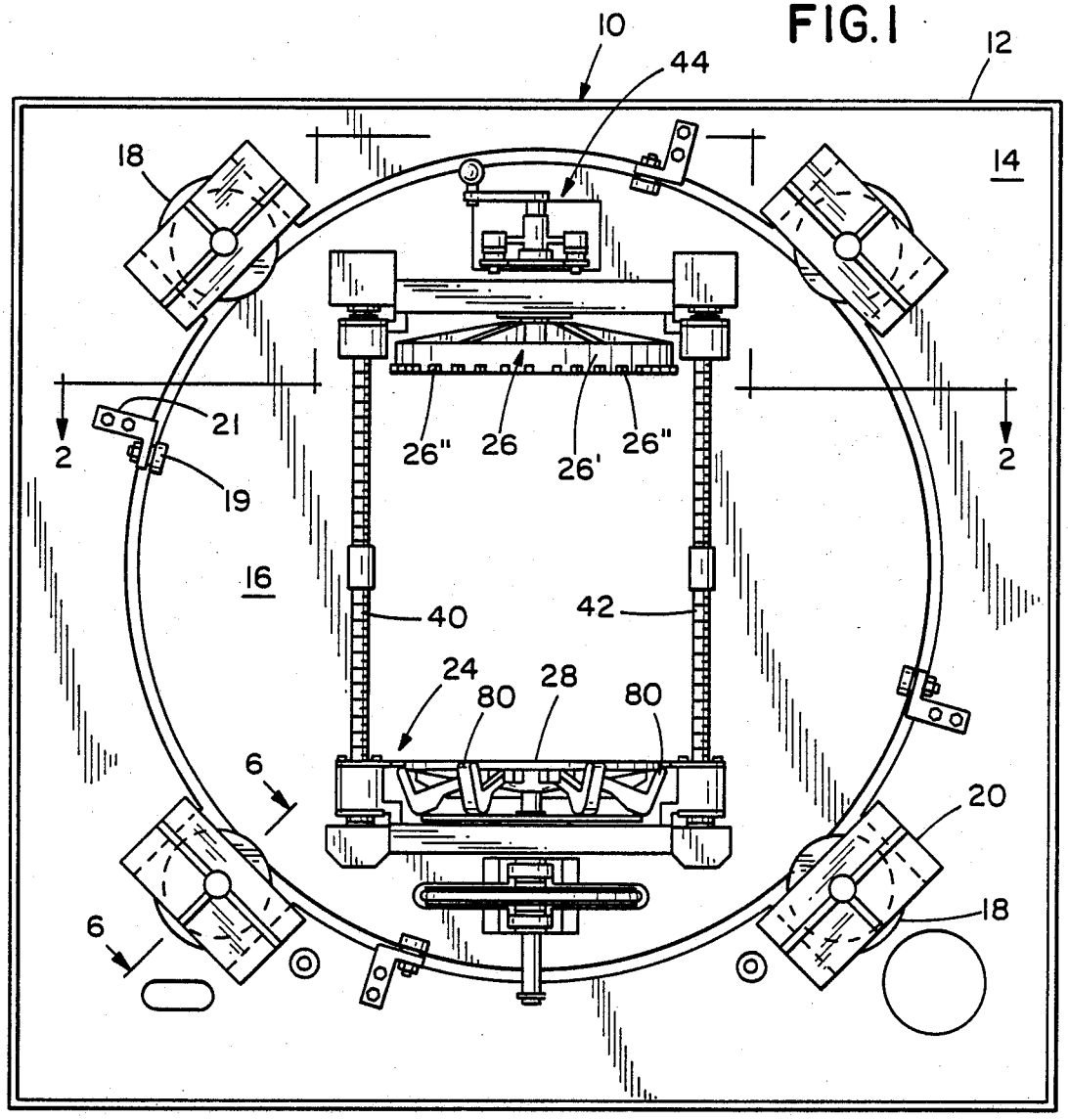
FIG. 1 is a front view of the paint can mixing apparatus of the invention, showing the rotatable mounting disc within a frame housing, and the clamping mechanism associated with the mounting disc.
Figure 2:
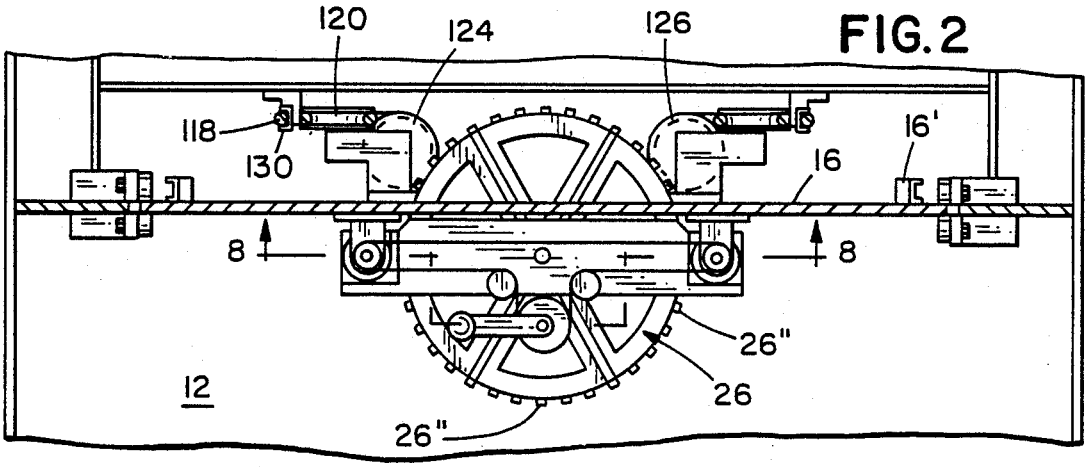
FIG. 2 is a view taken along line 2—2 of FIG. 1.
Figure 5:
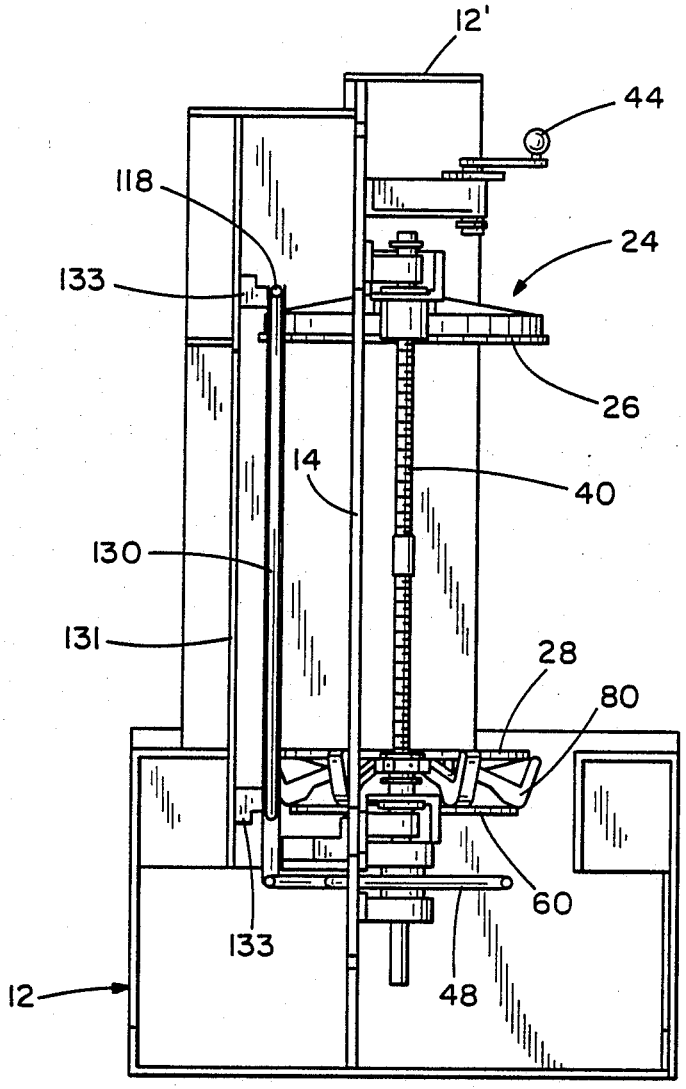
FIG. 5 is a side elevational view of the paint mixing apparatus of the invention, showing the clamping mechanism mounted by the mounting discs, with the upper and lower clamping plates thereof extending on either vertical surface of the mounting disc.
Figure 6:
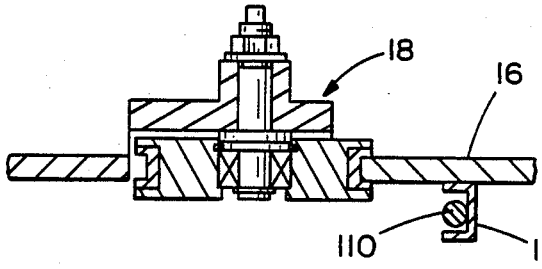
FIG. 6 is a cross-sectional view taken along lines 6—6 of FIG. 1.
Figure 7:
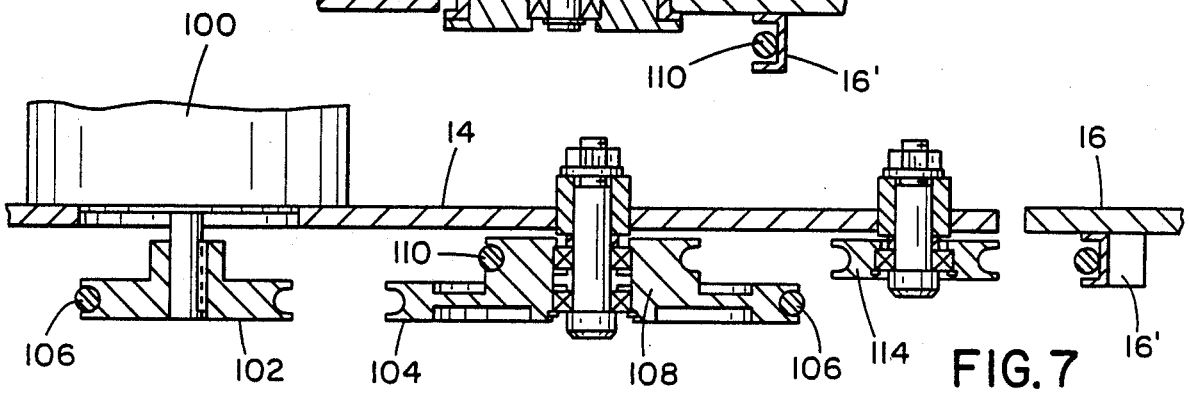
FIG. 7 is a cross-sectional view taken along lines 7—7 of FIG. 3.
Figure 11:
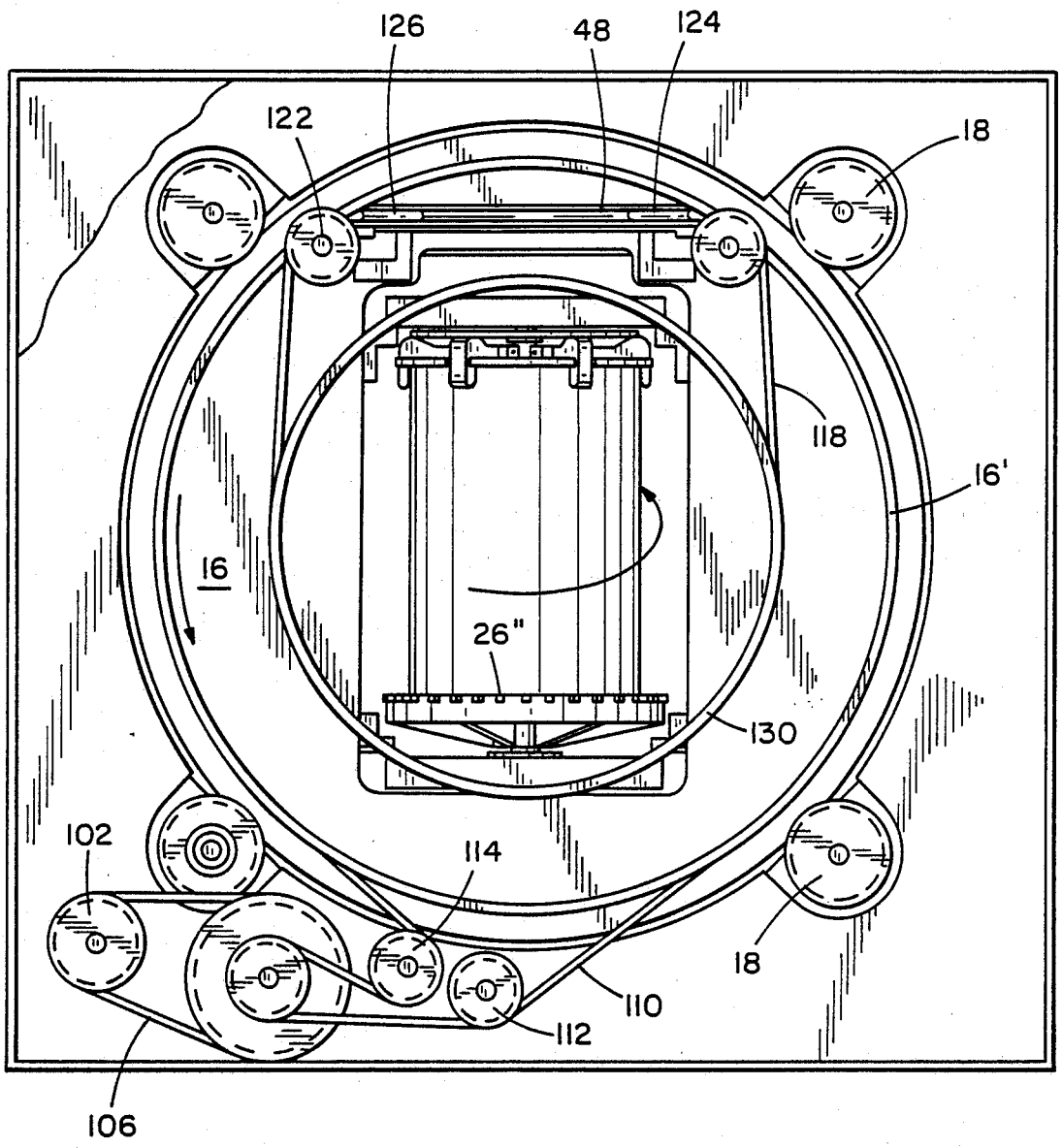
FIG. 11 is a view similar to FIG. 3 showing the clamping mechanism rotated 180 degrees as compared to the state shown in FIG. 3.

Referring now to the drawings in greater detail, the paint mixing apparatus of the invention is indicated generally by reference symbol 10. Referring to FIGS. 1, 2 and 5, the paint mixing apparatus includes a self-standing housing 12 which defines a vertically oriented, upstanding frame housing 12' in which is mounted the remaing structure of the paint mixing apparatus 10. As shown in FIG. 5, the upper vertical housing 12' includes a mounting frame plate 14 which is provided with a substantially circular cut-out for receiving therein a rotatable mounting disc 16. The cut-out is also formed with a plurality of corner cut-outs for receiving therein mounting cam rollers 18 and 19 with associated block housing 20, 21 for rotatably mounting the mounting disc 16 therein. Rollers 18 and 19 are oriented 90 degrees with respect to each roller. As is clear from FIG. 2, the mounting disc 16 is substantially relatively narrow in thickness. The mounting disc 16 is provided with a substantially rectangular central cut-out portion 22, which is best seen in FIG. 11, in which is mounted, for conjoint rotation with the mounting disc, a clamping assembly 24. As can be seen in FIGS. 2 and 5, the width of the clamping assembly 24 is substantially greater than the thickness of the mounting disc 16 so that the clamping assembly projects outwardly from either vertical side surface of the mounting disc 16. The rectangular shaped cut-out 22 in the central portion of the mounting disc 16 allows for the feed through of paint cans or containers to be supplied to the clamping mechanism 24 for subsequent gyratory motion and the mixing attained thereby during the operation of the apparatus 10.

Figure 8:
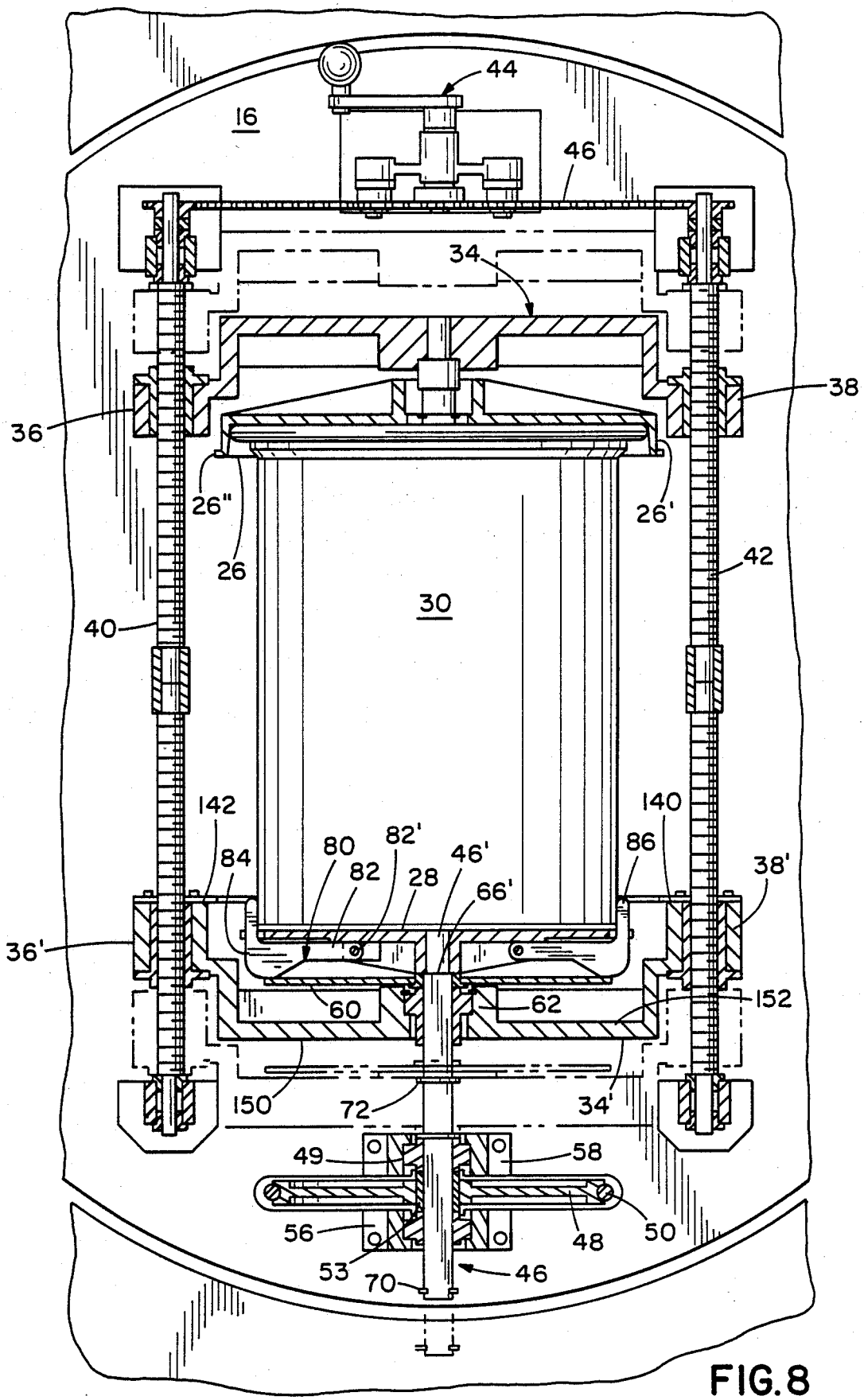
FIG. 8 is a cross-sectional view taken along line 8—8 of FIG. 2.

The clamping mechanism 24 includes an upper clamping plate or platen 26, and a lower clamping plate or platen 28, as best seen in FIGS. 1, 5 and 8. The upper clamping plate defines a downwardly projecting, peripheral flange or beaded portion 26' for receiving therein the upper rim or end of a paint container, or can, 30, as shown in FIG. 8. Typically, the paint can or container 30 has a five gallon capacity, with its upper end being received snugly within the peripheral flange or beaded portion 26', although paint cans or containers of smaller capacity may also be accommodated by the apparatus 10, and, to a limited degree, paint containers of greater capacity than five gallons. The lower edge of the peripheral flange or beaded portion 26' is provided with a series of spaced-apart hook members 26'', each hook member 26'' extending outwardly from the lower edge surfaces of the circular flange member 26'. These series of hook members 26'' provide for the fixed orientation of the handle or bail of the paint can or container 30 during the mixing process. The conventional handle of a paint can or container is pivotally mounted to the body of the can, and any one of the hook or hooks 26'' may be used for fixedly holding the handle during the rotation of the paint can in its revolution thereof, so as to prevent the handle from flying around haphazardly and, perchance, causing injury to a bystander or the operator. Which of the hook-like members 26'' are used depends upon the initial orientation of the can in the clamping mechanism 24. The upper clamping plate or platen 26 is rotatably mounted by conventional bearings on a shaft 32, so that the upper plate or clamping plate 26 has free rotation as the can 30 is rotated during the mixing process. The shaft 32 is connected at its upper end to a moveable arm or spider 34 (FIG. 8) defining at its two distal ends a pair of interiorly-threaded sleeves or blocks 36, 38, through which blocks 36, 38 is threaded a pair of threaded traversing shafts or rods 40, 42. Each of the threaded rods, 40, 42 includes a pair of threaded portions having oppositely-sensed threads. The mounting disc 16 also rotatably mounts a manually-rotatable handle assembly 44 which is used for rotating the pair of threaded rods 40 and 42 via a conventional belt or chain connection 46. Thus, as the handle assembly 44 is rotated in a first direction, the pair of threaded rods 40 and 42 is caused to rotate in a first direction, such as clockwise, to thereby cause the lowering of the spider arm 34 along with the upper clamping platen 26 therewith during the clamping process to clamp a can 30 in the apparatus. The lower clamping plate 28 is also operatively connected with the threaded rods 40 and 42, but to the portions of the rods having the opposite sense threads as compared with the portions of the rods operatively coupled with the upper clamping plate 26. Specifically, the lower clamping plate or platen 28 is operatively coupled to the lower end portions of the threaded shafts 40 and 42 via a second spidar arm 34' having at its ends a pair of interiorly-threaded blocks or sleeves 36' 38', similar to the blocks 36 and 38 of the upper clamping assembly. The blocks 36' and 38' receive therein the lower end portions of the threaded rods 40 and 42, which lower end portions have oppositely sensed threads as compared with the upper end portions of the rods 40 and 42, so that upon rotation of the handle assembly 44, downward movement of the upper clamping plate 26 is accompanied by the upward movement of the lower clamping plate 28. Thus, rotation of the handle assembly 44 in another direction, as for example, the counter-clockwise direction, will cause the conjoint movement of the lower and upper clamping plates, where the upper clamping plate will move the upper direction, while the lower clamping plate will move in the downward direction, for releasing the can 30 from the apparatus after the mixing process has been completed. The lower clamping plate 28 is also rotatedly mounted but is positively driven via a hexagonally-shaped driven shaft 46, this seen in FIG. 8. This driven shaft 46 has an upper end 46' of substantially circular cross section which is threadingly received in a hollow, interiorly-threaded sleeve projection or hub 47 projecting downwardly from the central portion of the lower clamping late 28, whereby the driven rotation of the shaft 46 will cause the rotation of the lower clamping plate 28, to thereby cause the rotation of the can 30 about its central longitudinal axis, which central longitudinal axis lies colinear with the central longitudinal axis of the driven shaft 46. The driven shaft 46 is rotably driven via a pulley 48 driven via a belt 50, which belt 50 is part of a driving assembly to be described below in greater detail. The pulley 48 is provided with a central hollow hub which is substantially hexagonally-shaped to allow for the connection with the hexagonally-shaped driven shaft 46, so that when the pulley 48 is driven, the driven shaft 46 is simultaneously rotated therewith. The hexagonally-shaped shaft and the hexagonally-shaped hollow hub associated with the pulley 48 allows not only for the conjoint rotation of the pulley 48 and driven shaft 46, but also allows for the sliding movement of the driven shaft 46 relative to the hub 49 of the pulley. The pulley 48 and the shaft 46 are rotatably mounted via a pair of bearings suitably affixed to a surface face of the mounting disc 16 via journal housings 56 and 58. Thus, it may be seen, that the vertical upward or downward movement of the lower clamping plate 28 is accomplished via the sliding nature of the vertical shaft 46, to thereby accommodate all positions of the clamping plate 28 and any size of can to be mixed. The spider arm 34', when moved vertically in the upward or downward direction via the threaded rods 40 and 42, is not directly and fixedly coupled to the driven shaft 46, but causes firstly the vertical upward or downward movement of a contact or push plate or strike plate 60 relatively slidingly mounted with respect to the driven shaft 46. The spider arm 34' is provided with a substantially centrally located tubular projection or housing 62, the upper face of which is used for contact against the lower surface area of the strike plate 60, so that when the thread rods 40 and 42 are rotated to cause the upward movement of the spider 34', such upward movement causes the strike plate 60 to move therewith as the upper face of the tubular projection 62 abuts up against the lower contact face of the strike plate 60. The spider 34' is also relatively slidingly mounted with respect to the driven shaft 46 via a central tubular bore of the central mounting core 66 associated with the spider 34'. It is, of course, noted that the portion of the driven shaft 46 passing through the spider 34' is circular in cross section to allow for the rotation of the shaft relative to the spider 34'. Alternatively, the driven shaft 46 may also be hexagonally-shaped along its entire length until the sleeve 47, with the hollow bore of the core 66 of the spider 34' being circularin shape and suitably dimensioned so as to allow for the rotation of the shaft therein while simultaneously allowing for the relative sliding movement therebetween. Thus, it may be seen, that when the threaded shafts 40 and 42 are rotated in the clockwise direction, the spider arm 34' is moved vertically upwardly, which vertically upward movement causes the forward face of the hub 62 to abut against the lower surface of the strike plate 60, which in turn will cause the upward movement of the lower clamping plate 28 by contact of the upper surface of the strike plate 60 against the lower surface of the clamping plate 28, so that the lower clamping plate moves from a lower position indicated in dotted lines in FIG. 8, to that shown in solid lines in FIG. 8, which upward movement of the clamping plate 28 is associated with the relative sliding movement of the driven shaft 46 within the hexagonal bore of the pulley 48. In the preferred form of the invention, the strike plate 60 is provided with the lost motion of approximately one inch. Upward movement and downward movement of the shaft 46 and, of course, the associated clamping plate 28, are limited by retaining rings 70 and 72, respectively.

Figure 9:
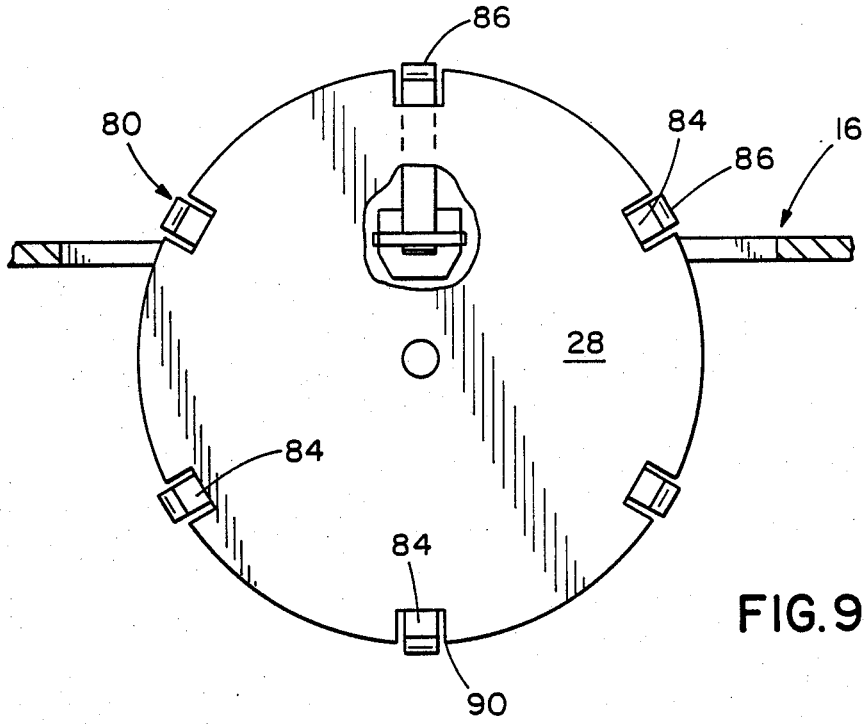
FIG. 9 is a top plan view taken along line 9—9 of FIG. 3 showing the lower clamping plate or platen.

Operatively associated with the lower clamping plate 28 are a plurality of pivotal clamping fingers or jaws 80, as seen in FIGS. 1, 3, 5, 8, and 9. In the preferred embodiment, there are provided six such clamping fingers or jaws 80. Each of the jaws or fingers 80 is pivotally connected to the undersurface of the clamping plate 28 proper by pivot pins 82, so that without any restriction therebelow, each finger or jaw 80 is allowed to pivot downwardly relative to the clamping plate 28. Furthermore, each of the jaws 80 is provided with a leaf spring for urging each jaw into its non-operative, non-clamping state, which springs are not shown in the drawings. Each of the jaws 80 includes a main body portion 82 which transforms into a transitional region 84 which defines a lower camming surface, which then projects upwardly, from the end of which is a vertically oriented finger-gripping portion 86, which vertically oriented finger-gripping portion 86 is that portion thereof that actually contacts and clamps the lower rim of the paint can or container 30, as clearly shown inFIG. 8. The lower camming surfaces of the transition portions 84 are that part of the gripping jaws against which the upper contact surface of the contact plate 60 abuts for causing the upward pivotal movement of the jaws during rotation of the threaded shafts 40 and 42, which, in turn, causes the upward movement of the spider 34' during the clamping process, prior to actual mixing via the apparatus 10. The clamping plate 28 is also provided with a plurality of circumferentially located notches 90, as seen in FIG. 9, which receive therethrough the projections of the finger-gripping portions 86 of the plurality of jaws 80. The interior surfaces of the finger-gripping portions 86 snugly enclose therein the lower rim of the paint can 30, to thereby not only firmly grasp the lower portion of the can to aid in the rotation thereof with the lower clamping plate 36, but also to achieve automatic centering of the can on the lower platen 28 during the clamping process. It may, therefore, be seen, that upon rotation of threaded shafts 40 and 42 to cause the upward movement of the spider 34', strike plate 60 firstly causes the upward pivotal movement of the six clamping jaws 80, to the point where they are in the operative clamping position shown in FIG. 8, with further upward movement of the plate 60 being accompanied by the abutment of the forward or upward surface 66' against the lower surface of the downwardly projecting central sleeve 46' of the lower platen 28, to thereby cause the upward movement of the platen 26 thereby. Thus, it may be seen that first occurs the upward pivotal movement of the jaws 80 to cause the clamping by the fingers thereof of the lower portion of the can 30, and, thereafter, the conjoint upward movement of the lower clamping plate 28 proper with the contact plate 60 and spider arm 34'. It is the lost motion of one inch of the contact or strike plate 60 that allows for this sequence of events, the one inch being measured between the upper or forward surface of 66' and the bottom or lower surface of the hollow central tubular sleeve 46'. It may also be seen that upon the unclamping of the clamping mechanism, to allow for the removal of the mixed can 30, rotation of the threaded rods 40 and 42 in the opposite direction will cause the spider arm 34' to move downwardly as well as the spider arm 34 to move upwardly, which downward movement of the spider arm 34' causes the downward movement of the strike palte 60, to thereby allow for the springs associated with the six clamping jaws 80 to pivot the jaws 80 downwardly into the non-clamping state thereof, the downward movement of the lower clamping plate 28 also ensuing thereby. The downward movement of the clamping plate 28 is achieved via the force of gravity, with the springs associated with the plurality of clamping jaws 80 causing the strike plate 60 to be moved downwardly, with the concomitant spacing of the contact surface 66' from the lower surface of the hollow tubular sleeve 46', to reposition the lower clamping plate in its non-operative, non-clamping initial state.

Figure 10:
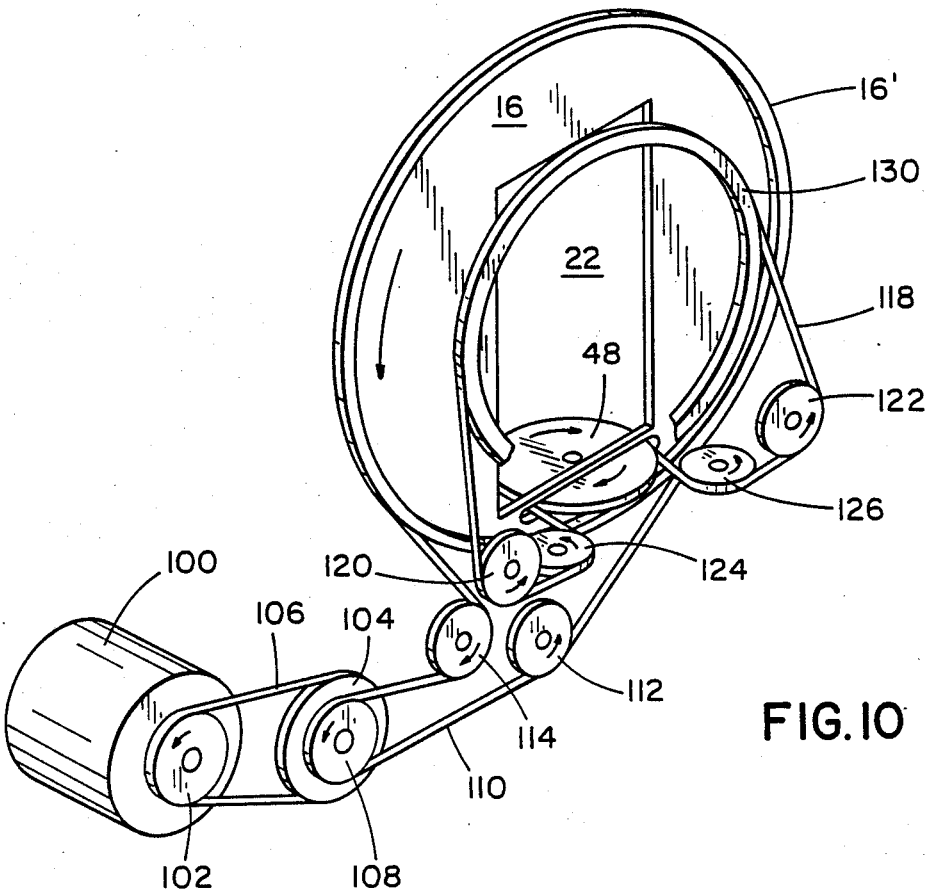
FIG. 10 is an isometric view showing the dual drive pulley and belt mechanism of the paint mixing apparatus of the invention, for causing the gyratory movement to the paint can being mixed.

The drive mechanisms for rotating the disc 16 and also for rotating the pulley 48, and, therefore, the lower clamping plate 28, is shown in FIGS. 3, 4, 7 and 10. Referring to FIG. 10, the first or primary drive mechanism includes one single drive motor 100, the output shaft of which drives pulleys 102, 104 via endless belt 106. Pulley 104 is coaxially mounted with pulley 108, which is the source for powering the mounting disc 16 and the pulley 48 via endless belt 110. The endless belt 110 is first entrained around pulley 112, and, thereafter, around a rearwardly- provided circular track 16' shown in FIGS. 2, 3, 6 and 10. This track 16' faces rearwardly toward the interior of the housing 12. The belt 110 is, thereafter, entrained around pulley 114 and from there back to the pulley 108. Thus, in the primary drive-belt mechanism, the motor 100 will cause the rotation of the disc 16, thereby also causing the revolution of the clamping mechanism and the clamped paint can or container 30. The second or secondary drive assembly accomplishes the rotation of the lower clamping plate 28, and, therefore, the conjoint rotation of the paint can 30 resting on the lower clamping plate 28, which rotation takes place about the vertical longitudinal axis of the shaft 46, when viewing FIG. 8. This drive belt arrangement is best seen in FIG. 10, and includes an endless belt 118 which is entrained around a pair of vertically-oriented pulleys 120, 122, and from there around a pair of horizontally-mounted direction-changing pulleys 124, 126, and then around the lower clamping plate drive pulley 48. The endless belt 118 is also entrained around a stationary circular track 130, which track 130 is best seen in FIGS. 2, 3, 4 and 10. The track 130 is fixedly and stationarily mounted to a rear, vertical mounting surface 131 of the housing 12, shown in FIG. 5, via a series of circularly-spaced bracket members 133. Upon the rotation of the disc 16 via themotor 100 and the primary belt-and-pulley arrangement above described, simultaneous rotation of the pulley 48 is achieved via the secondary assembly. This is accomplished since, during the rotation of the disc 16, the secondary pulley arrangement, defined by the pulleys 120, 126, 48, rotate therewith, as, for example, shown in the phase of the clamping arrangement of FIG. 11, where the clamping structure has been rotated 180 degrees. By such revolution of the secondary belt-and-pulley arrangement, the stationary endless belt 118, in contact with the stationary track 130, will cause the rotation of the pulley 48, and, therefore, the simultaneous rotation of the shaft 46 and the lower clamping plate 28 affixed to the shaft 46. Thus, it is seen that the one motor 100, when driving the mounting disc 16 to cause the revolution of the clamping mechanism, will simultaneously cause the rotation of the lower clamping plate, and, therefore, the rotation of the paint container, to thereby give to the paint container a gyratory motion of simple rotation and revolution, to thereby thoroughly and completely mix the contents thereof.

Figure 3:
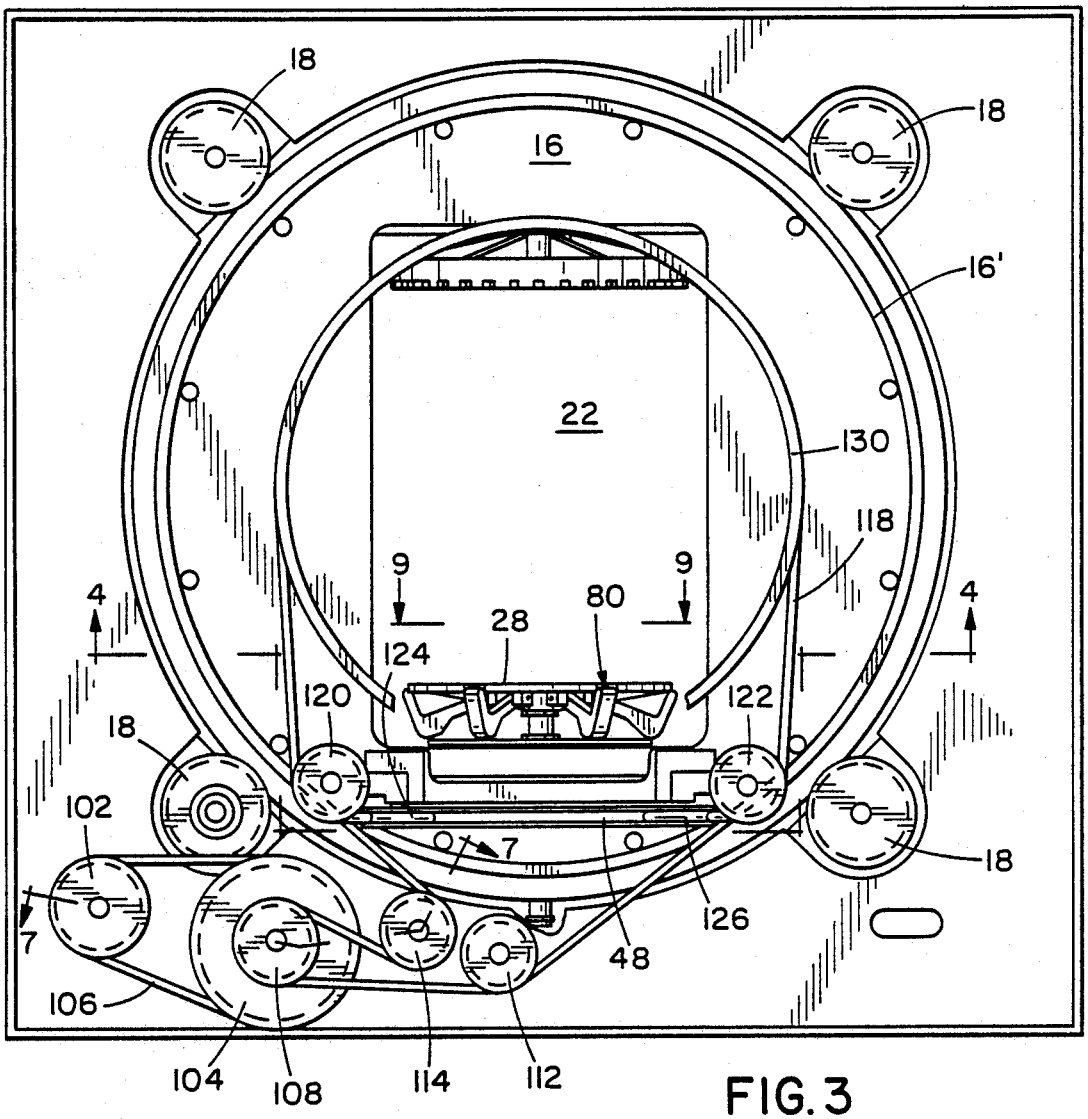
FIG. 3 is a rear view of the paint mixing apparatus.
Figure 4:
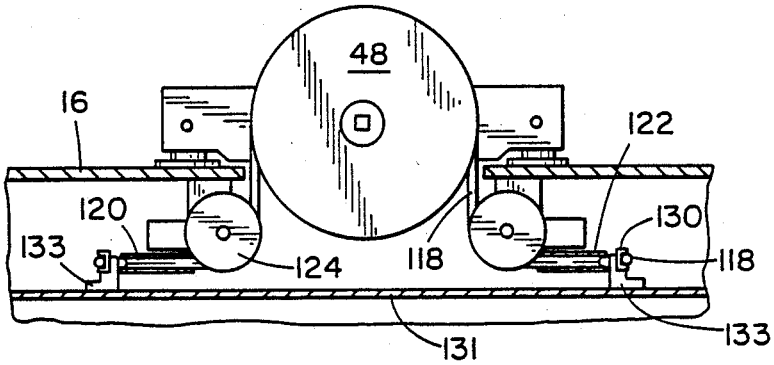
FIG. 4 is a view taken along line 4—4 of FIG. 3.
Figure 12:
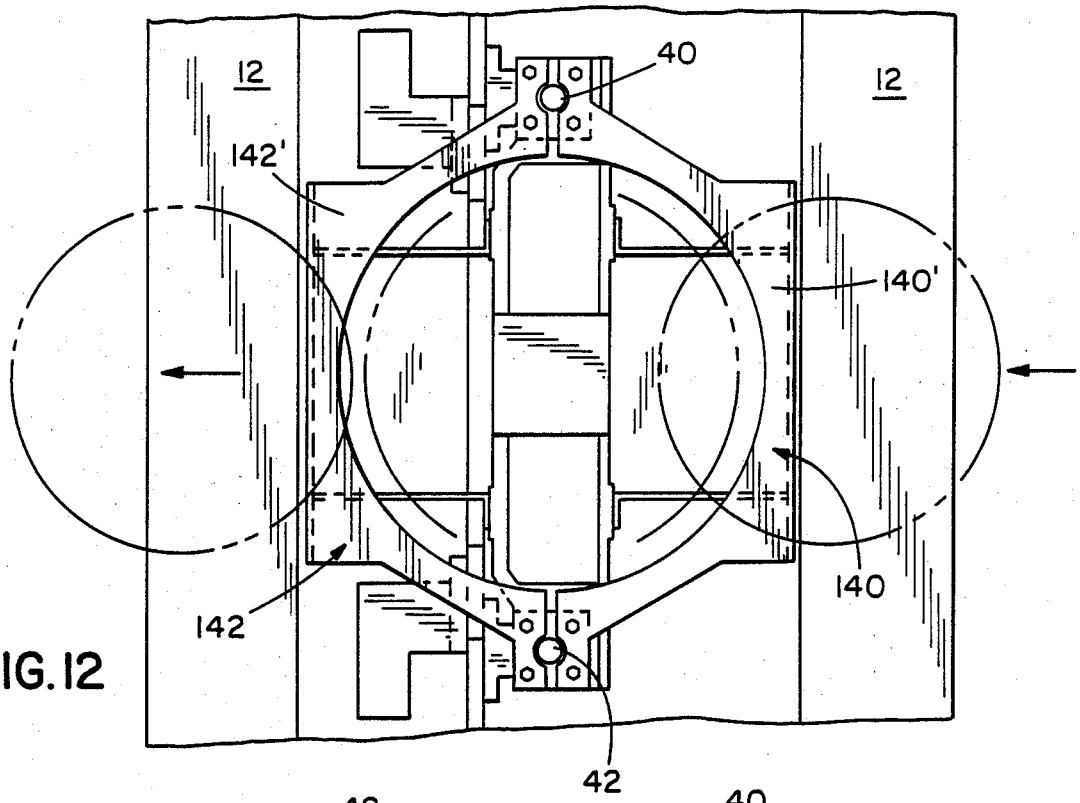
FIG. 12 is a top plan view of the forward and rear ramp plates operatively associated with the screw shafts for infeed and outfeed of the paint containers through the apparatus.
Figure 13:
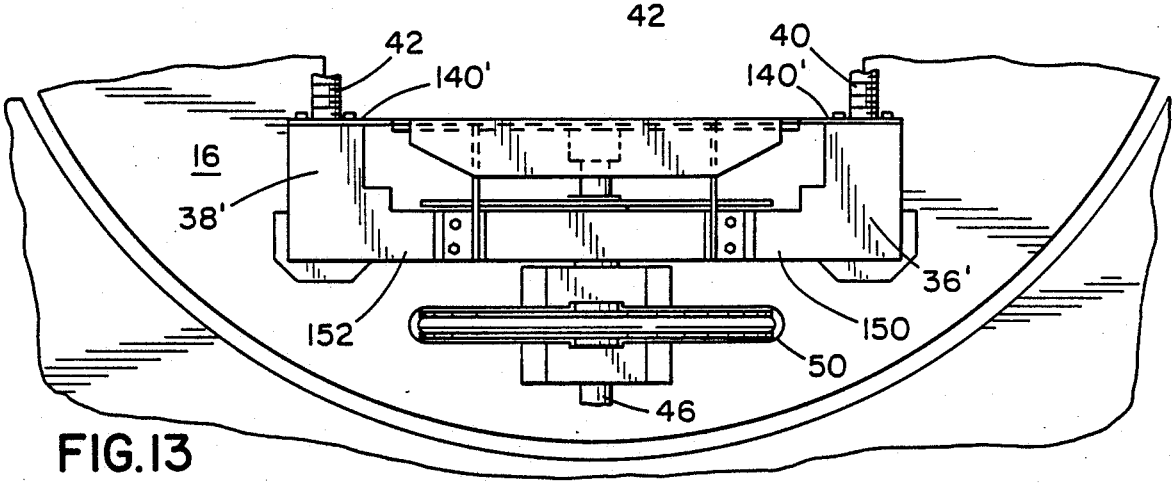
FIG. 13 is a side elevation view of the ramp plates of FIG. 12 and their interconnection with the screw shafts.
Figure 14:
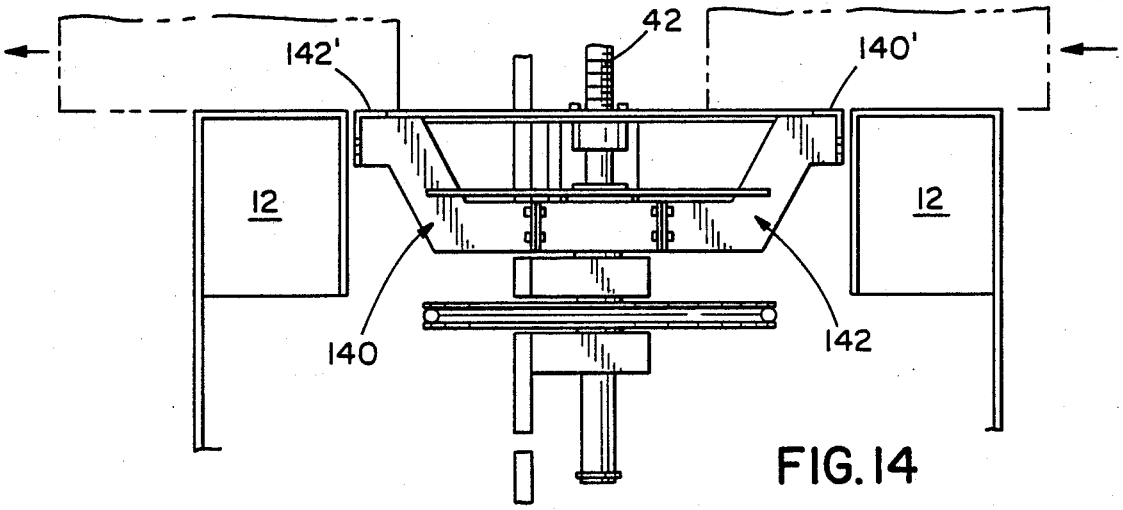
FIG. 14 is a front elevation view thereof.

In order to expedite the in-feed and out-feed of a plurality of paint cans to be mixed by the apparatus 10, as well as to allow for automatic conveyor operation thereof, a pair of ramp plates 140, 142 are provided, as shown in FIGS. 12–14. Each of these ramp plates 140 and 142 defines an upper flat support surface 140', 142' respectively, for the in-feed and out-feed of the paint cans, respectively. Each of these upper surfaces 140', 142′ is coplanar with the upper surface of the lower clamping plate 28. These ramp or ramp plates 140, 142 fill the gaps between the housing 12 and the upper surface of the lower clamping plate 28, to allow for continuous operation of feeding paint cans to be mixed through the apparatus 10, via the rectangular shaped window 22 thereof. Each of the ramps 140 and 142 rotates along with the mounting disc 16, and is moved conjointly with the lower plate 28 during its reciprocal translational movement via the threaded rods 40 and 42. Each of the ramp plates 140 and 142 is fixedly connected to the spider arms 150, 152 of the spider 34 as shown in in FIGS. 12 and 14, so as to ensure the movement of the upper surfaces of the ramp plates 140 and 142 as the threaded rods 40 and 42 move the clamping plate 28 in its up-and-down movement during clamping and unclamping. The upper surfaces 140′, 142′ of these ramp plates are, in their non-clamping state of the clamping mechanism, coplanar with the upper surface of the lower clamping plate 28. The one inch lost motion of the contact or strike plate 60 is taken into account. After the mixing process has been completed for each of the cans, any conventional mechanism may be used for orienting the lower clamping plate in its horizontal position, as shown in FIGS. 1 and 3, so as to allow for the removal of that paint can and for the insertion of another paint can to be mixed, the upper surfaces of the ramp plates facilitating such. Furthermore, the pulley 48, as shown in FIG. 8, is provided with a one-way clutch mechanism, 53, in order to allow for manual rotation of this pulley 48 at the end of the mixing process, in order to orient the handle or bail of the paint can correctly, to allow for removal of the paint can via an operater from the front of the apparatus.

While a specific embodiment of the invention has been shown and described, it is to be understood that numerous changes and modifications may be made therein without departing from the scope, spirit and intent of the invention as set forth in the appended claims.

What I claim is:

1. An apparatus for mixing paint cans, or the like, comprising:

a main housing;

a rotatable mounting disc, said main housing having means for rotatably mounting said mounting disc for rotation in a vertical plane;

said rotatable mounting disc having a central cut-out portion allowing for the in-feed and out-feed of paint cans to be mixed by the apparatus therethrough from the front toward the rear;

a clamping means positioned in said cut-out of said rotatable mounting disc for clamping a paint can to be mixed, said clamping mechanism comprising an upper clamping plate, a lower clamping plate, and means for simultaneously moving said upper and lower clamping plates toward or away from each other for clamping and unclamping a paint can thereby, said clamping means being connected to the said rotatable mounting disc for rotation therewith;

said rotatable mounting disc comprising a first rearwardly projecting arcuate track means, and said main housing comprising a second rearwardly mounted arcuate track means, said second track means being mounted rearwardly of said first track means;

a first drive-belt assembly operatively coupled to said first track means for rotatingly driving said mounting disc;

a second belt-drive assembly independent of said first drive assembly and operatively coupled to said second track means, said second belt-drive assembly comprising a plurality of direction-changing pulleys mounted to said mounting disc for rotation therewith during the mixing process;

said clamping mechanism further comprising a driven shaft connected to said lower clamping plate for rotating said lower clamping plate about the central longitudinal axis of said driven shaft, and a drive pulley mounting said driven shaft therein for rotatingly driving said driven shaft, said drive pulley having a central hub slidingly mounting said driven shaft therein to allow for the vertical movement of said lower clamping plate during the clamping and unclamping of a paint can; and motor means for driving said first belt-drive assembly to cause the rotation of said mounting disc.

2. The apparatus according to claim 1, wherein said means for simultaneously moving said upper and lower clamping plates comprises at least one threaded rod, said threaded rod having a first half-length thereof of threads of one sense, and a second half-length thereof of threads of opposite sense, whereby rotation of said shaft causes the opposite movement of said upper and lower lower clamping plates simultaneously; and means for rotating said threaded shaft.

3. The apparatus according to claim 2, wherein said clamping mechanism further comprises a mounting arm means having at least one end thereof, and at least one interiorly-threaded sleeve for threaded cooperation with one of said threaded half-lengths of said at least one threaded rod, a strike plate having a central passage therethrough through which projects said driven shaft so as to provide relative sliding movement between said strike plate and said driven shaft, said mounting arm means being in contact against the lower surface of said strike plate during the movement thereof, whereby upward movement of said mounting arm means via said threaded rod causes the concomitant upward movement of said strike plate, which in turn abuts up against said lower clamping plate to cause the upward movement thereof during the clamping of a paint can for subsequent mixing by the apparatus, said upward movement of said lower clamping plate via said strike plate being achieved via the sliding engagement of said driven shaft within said hub of said drive pulley.

4. The apparatus according to claim 3, wherein said clamping mechanism further comprises a plurality of pivotally mounted, angularly spaced-apart clamping fingers, each said clamping finger having a first end portion pivotally connected to said lower clamping plate to provide pivotal movement to each said clamping finger in a vertical plane;

said lower clamping plate comprising a plurality of angularly spaced apart peripheral cut-outs;

each said clamping finger further having a second end portion moveable within a respective one of said plurality of cut-outs of said lower clamping plate at the periphery of said lower clamping plate, each said clamping finger further comprising a central region between such first and second end portions defining a camming surface against which said strike plate abuts during the upper movement thereof to thereby cause each said clamping finger to pivot upwardly thereby and to cause the respective said second end portion thereof to project through a respective one of the said plurality of cut-outs of said lower clamping plate, whereby said plurality of clamping fingers automatically clamp therebetween a lower rim of a paint can being mixed, and also simultaneously and automatically center the lower rim of the paint can on the upper surface of said lower clamping plate.

5. The apparatus according to claim 4, wherein each of said second end portions of each said clamping finger defines a substantially flat surface for contact against the lower rim of a paint can, each said flat surface lying in a substantially vertical plane during the clamping procedure of clamping a paint can by said clamping mechanism.

6. The apparatus according to claim 5, wherein said means for simultaneously moving comprises a first and a second said threaded rod oriented on diametrically-opposite sides of said upper and lower clamping plates, and extending substantially parallel to the front surface of said mounting disc and spaced therefrom;

and a first and second said interiorly-threaded sleeve for threading engagement with said first and second threaded rods, respectively;

said mounting arm means of said clamping mechanism comprising a first arm portion at one end of which is provided said first interiorly-threaded sleeve and a second arm portion colinear with said first arm portion and diametrically opposed thereto and having one end thereof mounting said second interiorly-threaded sleeve;

said mounting arm means further comprising a central hub portion slidingly mounting therein said driven shaft, said central hub portion comprising an end surface portion thereof which abuts up against a lower surface portion of said lower clamping plate to thereby move said lower clamping plate upwardly when said mounting arm means is moved upwardly via said first and second threaded rods.

7. The apparatus according to claim 6, wherein said strike plate is mounted angularly about said end surface portion of said central hub of said mounting arm means, the uppermost surface portion of said central hub of said mounting arm means lying in a plane spaced vertically upwardly from the upper surface of said strike plate, said upper surface portion of said central hub of said mounting arm means being spaced from the lower surface portions of said lower clamping plate during the non-clamping state of said clamping mechanism, whereby a lost motion is provided to allow for firstly the contact of said strike plate against said camming surfaces of said clamping fingers to thereby initialize said clamping fingers in their operative automatically-centering state, and thereafter allowing for the upward movement of said lower clamping plate conjointly with the upward movement of said upper surface portion of said central hub of said mounting arm means.

8. The apparatus according to claim 1, wherein said central hub of said drive pulley and said driven shaft are both hexagonally-shaped to allow for the conjoint rotation thereof while allowing said sliding movement therebetween.

9. The apparatus to claim 1, wherein said central hub of said drive pulley comprises a one-way clutch to allow for the manual rotation of said drive pulley in one direction only, so that, upon the ending of the mixing process, said lower clamping plate may be rotated manually to a desired orientation in order to allow for access to the handle of the paint can by an operator.

10. The apparatus according to claim 1, further comprising a first and second ramp plate means disposed on opposite sides of said mounting disc, said first ramp plate means being positioned forwardly of said mounting disc and said second ramp plate means being positioned rearwardly of said mounting disc, each of said first and second ramp plate means defining an upper horizontal support surface that, in the inoperative clamping state of said clamping mechanism, lies coplanar with the upper surface of said lower clamping plate, said first and second ramp plate mean filling the gap between portions of said housing lying on either side of said mounting disc and the front and rear surfaces of said mounting disc, whereby in-feed and out-feed of paint cans for mixing in the apparatus is facilitated.

11. The apparatus according to claim 10, wherein each of said first and second ramp plate means is operatively coupled to said mounting arm means for conjoint translational movement therewith, so that said supporting surface of each of said first and second ramp plate means lies co-planer with said upper supporting surface when said lower clamping plate is in its non-clamping state.

12. An apparatus for mixing paint cans and the like, comprising:

a main housing;

a rotatable disc mounted by said main housing, said main housing having means for rotatably mounting said mounting disc;

a clamping mechanism mounted by said mounting disc and rotatable therewith, said clamping mechanism comprising an upper clamping platen means and a lower clamping platen means, means for moving at least said lower clamping platen means toward and away from said upper clamping platen means;

said lower clamping platen means comprising a rotatable plate means defining an upper flat supporting surface, and a lower surface, said rotatable plate means .pa comprising a plurality of angularly spaced-apart, circumferentially-positioned cut-outs;

said lower clamping platen means further comprising a plurality of angularly spaced-apart clamping centering fingers, each said finger having a first end portion pivotally connected to said lower surface of said plate means, and a second end portion spaced from said first end portion defining a contact surface facing inwardly toward the center of said plate means, each of said fingers further comprising a middle portion thereof defining a camming surface;

and means for pivotally mounting each of said first end portins of said fingers to said lower surface of said plate means, whereby said second end portions of each of said fingers may be alternatively moved through a respective said cut-out, such that said second end portion projects upwardly above the upper supporting surface of said plate means.

said lower clamping platen means further comprising a rotatably driven shaft operatively connected to said plate means for rotating said plate means;

said means for moving comprising a push means through which extends a portion of said rotatably driven shaft, said push means being slidable relative to said rotatably driven shaft, said means for moving further comprising means for translating said push means in the upward direction toward said lower surface of said plate means, said push means contacting said camming surfaces of said plurality of clamping/centering fingers to cause the upward pivotal movement thereof about said means for pivoting, to thereby cause said second end portions of said plurality of fingers to project upwardly through said cut-outs and beyond said upper surface of said plate means, to thereby clamp and automatically center a lower rim portion of a paint can, whereby continued upward movement of said push means also causes the simultaneous raising of said plate means to thereby clamp a paint can between said lower clamping platen means and said upper clamping platen means; and means for rotating said mounting disc.

13. The apparatus according to claim 12, wherein both said upper clamping platen means and said lower clamping platen means are moveable toward and away from each other, said means for moving further comprising at least one threaded shaft, said threaded shaft having a first half thereof associated with said upper clamping platen means that is threaded in a first sense, and a second half thereof operatively associated with said lower clamping platen means that is threaded in the opposite sense;

said means for moving comprising at least one arm means having a first end, said first end of said at least one arm means comprising an interiorly threaded sleeve for threadingly receiving therein said second half of said threaded shaft, said at least one arm means comprising a central passageway through which extends said rotatably driven shaft, said arm means being slidingly mounted with respect to said rotatably driven shaft.

14. The apparatus according to claim 13, wherein said means for moving comprises a pair of said threaded shafts, said arm means comprising a spider defining a pair of diametrically-opposed arms, each said arm having a first end comprising a said threaded sleeve for respective engagement with a respective portion of one of said threaded shafts;

said means for moving further comprising a drive pulley having a central hub through which extends a portion of said rotatably driven shaft, said rotatably driven shaft also being slideable with respect to said central hub of said drive pulley.

15. The apparatus according to claim 13, wherein said means for rotating comprises a first drive assembly for directly rotating said mounting disc in a vertical plane, and a second drive assembly for rotating said lower clamping platen means, said second drive assembly being structurally isolated from and powered differently from said first drive assembly, said first drive assembly comprising motor means, said second drive assembly being powered by the rotation of said mounting disc.

16. The apparatus according to claim 15, wherein said first drive assembly further comprises a plurality of pulleys and an endless belt entrained around said plurality of pulleys;

said mounting disc comprising a rearwardly-projecting arcuate track means also about which is entrained said endless belt of said first drive assembly to thereby cause the rotation of said rotatable mounting disc;

said second drive assembly comprising a plurality of direction changing pulleys, and a second endless belt entrained around said direction changing pulleys, said second drive assembly further comprising a stationarily-mounted arcuate second track means, said second track means being mounted by said main housing, said second endless belt also being entrained around said second track means;

said plurality of direction changing pulleys being mounted by said rotatable mounting disc, such that said direction changing pulleys revolve about with the rotation of said mounting disc.

17. The apparatus according to claim 12, wherein said upper clamping platen means comprises a plurality of angularly spaced-apart, hook-like members for selectively anchoring a handle of a paint can being clamped by said clamping mechanism.

18. The apparatus according to claim 12, further comprising a pair of ramp means, each said ramp means defining an upper support surface, each said ramp means being structurally connected to said rotating mounting disc for rotation therewith; each said upper support surface of each said ramp means lying co-planar with the upper surface of said lower clamping platen means when said lower clamping platen means is in its non-clamping state; said mounting disc defining a substantially centrally-located cut-out which mounts therein said clamping mechanism, said upper surfaces of said ramp means providing surfaces for the in-feed and out-feed of a plurality of paint cans through the apparatus and by conveyor belt to achieve an automated operation thereof;

each said ramp means also being structurally connected with said means for moving said lower clamping platen means for at least partial conjoint movement therewith.

19. An apparatus for mixing paint cans, and the like, comprising:

a main housing;

a rotatable mounting disc rotatably mounted by said main housing;

said rotatable mounting disc comprising a central cut-out portion;

a clamping mechanism mounted by said mounting disc, at least a portion of said clamping mechanism being positioned within said cut-out of said mounting disc;

said clamping mechanism comprising an upper clamping plate means and a lower clamping plate means, at least said lower clamping plate means be moveable toward and away from said upper clamping plate means for clamping a paint can therebetween and for unclamping it;

said mounting disc defining a front surface and a rear surface, each of said upper and lower clamping plate means having a portion thereof extending forwardly beyond said front surface and a portion thereof extending rearwardly beyond said rear surface;

means for moving at least said lower clamping plate means toward and away from said upper clamping plate means for clamping and unclamping a paint can therebetween;

a first ramp means and second ramp means operatively associated with said lower clamping plate means, said first ramp means being operatively associated with said portion of said lower clamping plate means projecting forwardly from said front surface of said mounting disc, and said second ramp plate being operatively associated with said portion of said lower clamping plate means projecting rearwardly from said rear surface of said mounting disc, each of said first and second ramp means being operatively connected to said means, for moving said lower clamping plate means each of said first and second ramp means defining an upper supporting surface substantially coplanar with the upper supporting surface of said lower clamping plate means when said lower clamping plate means is in its non-clamping state;

said means for moving said lower clamping plate means being mounted by said rotatable mounting disc, whereby said upper and lower clamping plate means, said means for moving said lower clamping plate means, and said first and second ramp means revolve about along with the said rotation of said mounting disc;

each of said first and second ramp means filling the gap between outer circumferential portions of said lower clamping plate means and respective portions of said main housing, in order to allow for the feeding of paint cans to the clamping mechanism and through said cut-out portion of said rotatable mounting disc; and means for rotating said mounting disc and for rotating said lower clamping plate means around the central axis thereof.

* * * * *